United States Patent [19]

Strzepek

[11] 4,098,026

[45] Jul. 4, 1978

[54] WINDOW ASSEMBLY

[76] Inventor: Joseph A. Strzepek, 2241 Poland, Hamtramck, Mich. 48212

[21] Appl. No.: 860,817

[22] Filed: Dec. 15, 1977

[51] Int. Cl.[2] ..... E06B 3/34

[52] U.S. Cl. ..... 49/390

[58] Field of Search ..... 49/398, 388, 389, 391, 49/392, 393

[56] References Cited

U.S. PATENT DOCUMENTS

| | | | |
|---|---|---|---|
| 488,761 | 12/1892 | Giesey | 49/390 |
| 2,812,557 | 11/1957 | Hauck | 49/390 |
| 3,553,985 | 1/1971 | Pepp, Jr. et al. | 49/388 X |
| 3,676,955 | 7/1972 | Schacht | 49/390 X |

*Primary Examiner*—Philip C. Kannan

*Attorney, Agent, or Firm*—Cullen, Settle, Sloman & Cantor

[57] ABSTRACT

A window assembly is provided for a building wall having an aperture which includes a housing nested and secured within said aperture having side plates, top and bottom plates. Each side plate has an inwardly opening upright recess of a predetermined horizontal depth defining stop ledges. A hallow frame is snugly nested within said housing and within said recesses and bears against said top, bottom and side plates. Headed fasteners engage and project through said frame and are threaded into said housing. Said frame has an internal recess. A glazed window is nested within said recess and is swivelly mounted therein upon a vertical axis and adapted for rotation throughout 360°. The swivel mounting includes pairs of vertically aligned fasteners journalled though the central top and bottom portions of the window including pivot shanks at their ends which project from the window and are threaded within corresponding threaded bores in cups secured within the frame. At least one latch on the frame secures the window within the frame in one of two 180° related positions.

1 Claim, 4 Drawing Figures

WINDOW ASSEMBLY

BACKGROUND OF THE INVENTION

Windows, swivelly mounted on vertical and horizontal axes, are known in the art as exemplified by the following U.S. Pat. Nos.:

2,739,355
3,771,264
1,982,753
2,812,557
488,761
3,553,985
3,443,624
2,185,888
2,888,721
1,820,346

In the above recited Patents, various mechanisms are involved for pivotally mounting the windows, latching the windows, and assembling the same, which structures are quite involved.

SUMMARY OF THE INVENTION

It is the object of the present invention to provide a complete window assembly for a building wall having an aperture and, wherein, the window assembly can be prefabricated as a unit and may be projected and secured within a building wall aperture.

It is another object to provide the complete window assembly which can incorporate a housing of rectangular shape with side, top and bottom walls, with the side walls recessed so as to cooperatively receive and enclose within the housing an apertured window frame. Nested and removably mounted within the window frame, there is provided a window which is swivelly mounted therein upon a vertical axis and is capable of rotation throughout 360° between two 180° related positions.

It is another object to provide an improved and simplified assembly for removably mounting a frame within the housing and a simplified swivel assembly for mounting and securing the window within the frame and to facilitate its rotation therein upon a vertical axis.

These and other objects will be seen from the following specification and Claim in conjunction with the appended drawing.

THE DRAWING

Figure 2:
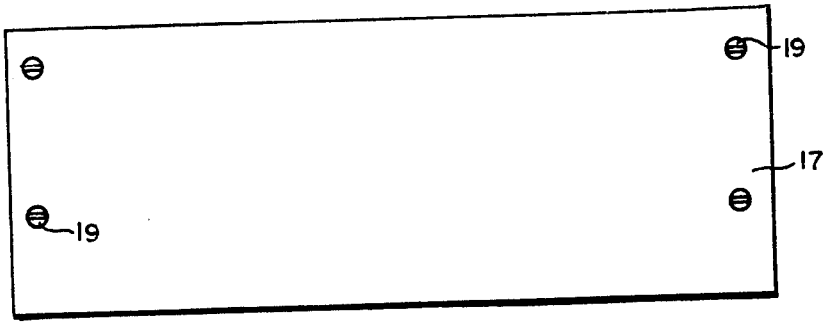
FIG. 2 is a plan view of the housing for the window assembly.

It will be understood that the above drawing illustrates merely a preferred embodiment of the invention, and that other embodiments are contemplated within the scope of the Claim hereafter set forth.

DETAILED DESCRIPTION OF THE INVENTION

Referring to the drawing, within any building wall 47 having a rectangular aperture 49, there is projected and secured the present window assembly.

Said window assembly includes a hollow rectangular housing 11 having a pair of upright side plates 13 and mounted respectively over the top and bottom thereof, the top and bottom plates 17 and 15. Suitable fasteners 19, FIG. 2, anchor said plates with respect to the side plates to provide a unit assembly. It is this assembly which is projected within the rectangular aperture 49 shown in FIG. 1 and suitably secured in place.

The corresponding side plates of said housing each have inwardly opening upright recesses 21 of right angular shape and which extend from the top and bottom of said side plates and are of a predetermined horizontal depth, thus, defining the stop ledges 25 within said housing.

A hollow rectangular frame 23 of a thickness corresponding to said predetermined horizontal depth is snugly nested within the housing and within the recesses 25 so that the outer surfaces of said frame are flush with the outer surface of said housing.

Figure 3:
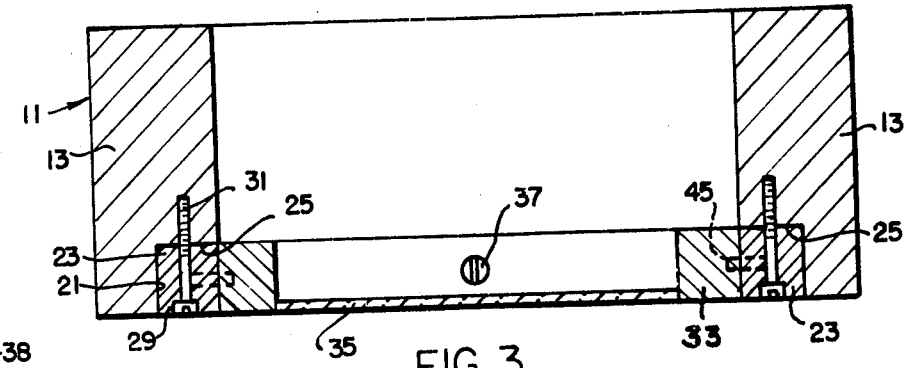
FIG. 3 is a fragmentary section taken in the direction of arrows 3—3 of FIG. 1.

A plurality of headed fasteners 27 extend through corresponding apertures 29 within corner or other portions of the frame 23 and are threaded into the threaded bore 31 within said housing in the manner shown in FIG. 3.

Said frame has an internal recess 24 therethrough of rectangular shape, for illustration, though it could be of any desired shape, and nested within said recess is the rectangular or other shaped window 33. Said window is of the same depth as its frame and is enclosed within the boundries thereof. Said window has the usual stiles and headers and is of a shape as to loosely nest within recess 24 within frame 23, and includes a conventional glazing or glass 35.

Said window is swivelly mounted within frame 23 and is capable of rotation therein throughout 360°.

The swivel mounting for said window includes the pair of vertically aligned outwardly directed fasteners 37 which project outwardly through and journal central portions of the window at 39. Said fasteners terminate beyond said window in the threaded ends 41. Each end is threaded into a corresponding threaded bore 43 with an anchor cup 44 nested and retained within frame 23.

Due to the accurate location of the fasteners 37 within the window and cups 44 within the frame, the window is capable of rotation throughout 360° with respect to its frame to one of two 180° positions in which it can be secured by a conventional latch 45. The fasteners are formed to receive a screw driver or an Alan wrench.

Said pair of fasteners provide a fast means for pivotally mounting the window within its frame. Once the fasteners are anchored within said cups, the window is journalled for rotation about portions 39 of said fasteners.

One or more of said latches are nested within said frame, are manually operable and include retractable latch elements normally nested within corresponding apertures in side portions of window 33.

Figure 1:
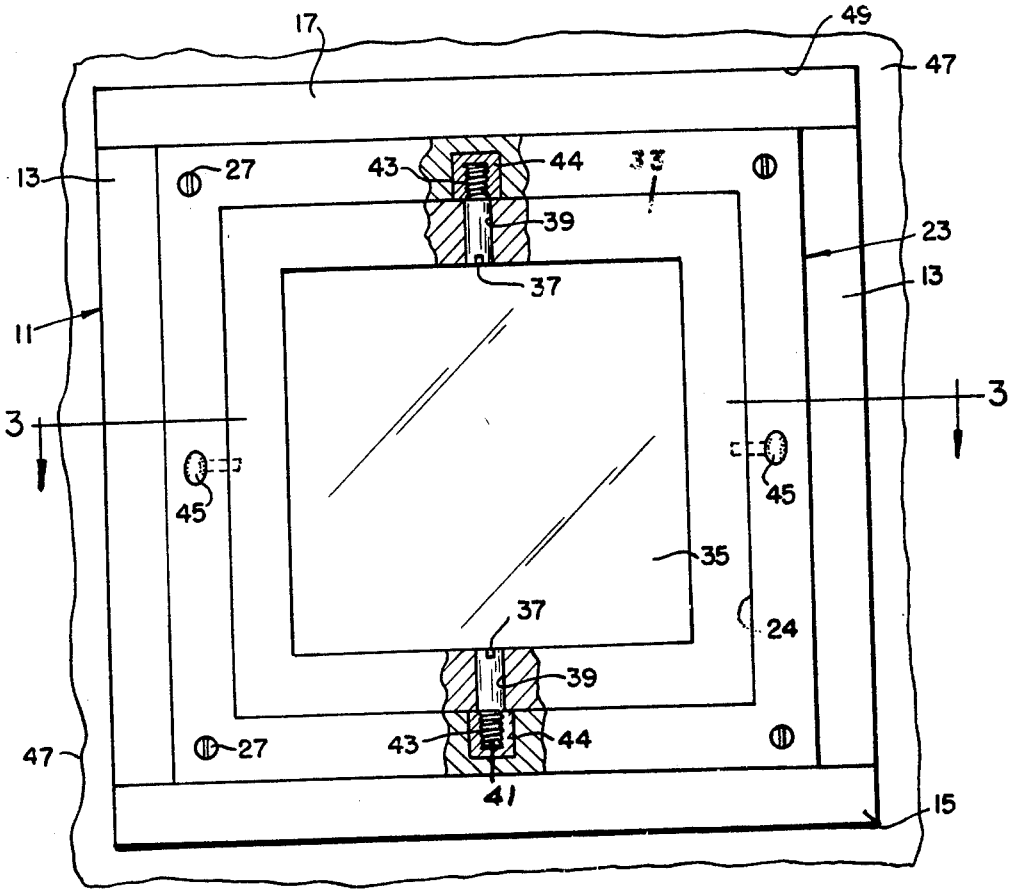
FIG. 1 is an elevational view showing a building wall with the present window assembly secured therein.

In the illustrative embodiment, a pair of said latches are provided for fixedly securing the window coplaner with its frame as best shown in FIGS. 1 and 3.

Fasteners 37, FIG. 1, rotatively journal window 33, and are secured at their threaded ends within said frame.

Figure 4:
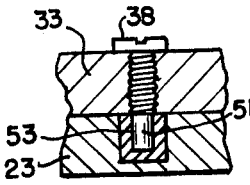
FIG. 4 is a fragmentary section of a modified window pivot mounting.

An equivalent construction is shown in FIG. 4, wherein headed fasteners 38 are threaded through and secured to window 33. End portions 51 are journalled within cups 53 secured within frame 23.

Housing 11 including members 13, 15, and 17 is of such depth that on rotation of window 33, 90°, the outer half thereof is fully enclosed and contained within said housing with no overhang or lapover.

As shown in FIGS. 1 and 3, the window 33 may be removed from its frame 23 as easily as a light bulb, merely by removing fasteners 37.

The complete frame 23 with window 33 may be removed from its housing 11 as easily as a light bulb merely by removing fasteners 27.

Having described my invention, reference should now be had to the following claim.

1. A window assembly for a building having a wall with an aperture;

a housing nested and secured in said aperture, including opposed side plates and top and bottom plates;

said side plates each having an inwardly opening upright recess throughout their height of a predetermined horizontal depth defining stop ledges;

a hollow frame of a thickness substantially the same as said recess depth snugly nested within said housing and within said recesses, and bearing against said top, bottom and side plates;

headed fasteners engaging and projected through said frame and threaded into said housing;

said frame having an internal recess therethrough of predetermined shape;

and a glazed window of the same shape loosely nested within said recess and swivelly mounted thereon upon a vertical axis, adapted for rotation through 360°;

opposed aligned interiorly threaded cups nested within central portions of said frame;

said swivel mounting including a pair of opposed vertically aligned fasteners extending through and pivotally receiving central top and bottom portions of said window, and including ends projecting from said window and threaded into said cups;

said fasteners journalling and securing said window within said frame for rotation therein;

and at least one latch on said frame having a manually retractable element nested within a corresponding recess within said window, for securing it within said frame in one of two 180° related positions.

* * * * *